US005947420A

United States Patent [19]

Backman

[11] Patent Number: 5,947,420

[45] Date of Patent: Sep. 7, 1999

[54] KITE ACCESSORY RELEASE SYSTEM

[76] Inventor: Thomas J. Backman, 105 Core Dr., Morehead City, N.C. 28557

[21] Appl. No.: 09/085,614

[22] Filed: May 27, 1998

[51] Int. Cl.[6] ..... B64C 31/06

[52] U.S. Cl. ..... 244/155 R

[58] Field of Search ..... 244/153 R, 155 R, 244/155 A; 24/30, 5 R, 5 S, 482, DIG. 28

[56] References Cited

U.S. PATENT DOCUMENTS

| | | | |
|---|---|---|---|
| 2,480,948 | 9/1949 | Moon | 244/155 R |
| 2,983,471 | 5/1961 | Melvin | 244/155 |
| 3,052,434 | 9/1962 | Tucci | 244/155 R |
| 4,123,021 | 10/1978 | Cruise, Jr. | 244/155 |
| 4,129,274 | 12/1978 | Baker | 244/155 |
| 4,141,521 | 2/1979 | Waldvogel | 244/155 |
| 4,183,481 | 1/1980 | Elson | 244/153 |
| 4,515,202 | 5/1985 | Wilson | 24/DIG. 28 |
| 4,570,304 | 2/1986 | Montreuil et al. | 24/DIG. 28 |
| 4,705,239 | 11/1987 | Baird | 244/155 |
| 4,799,634 | 1/1989 | Beaulieu | 244/155 |
| 5,072,899 | 12/1991 | Nickle | 244/155 |

*Primary Examiner*—Galen L. Barefoot
*Attorney, Agent, or Firm*—Mills Law Firm PLLC

[57] ABSTRACT

A kite accessory release system for dropping toy projectiles and related items from a kite during flight is disclosed. The system includes a kite accessory release device comprised of a generally rectangular sheet of a deformable rubber material having at least one expandable slot formed therein to receive a release tab formed on each of the toy projectiles. The release device is deformable when stretched linearly so as to open the slot retaining the toy projectile and to allow it to fall by gravity from the device during flight of the kite. The release device is adaptable for use with various toy projectiles of different configurations such as toy bombs, airplanes, missiles, gyrocoptors, and parachutes.

7 Claims, 3 Drawing Sheets

KITE ACCESSORY RELEASE SYSTEM

BACKGROUND OF INVENTION

1. Field of Invention

This invention relates generally to kites and, more particularly, to a kite accessory release system which permits objects such as toy projectiles and parachutes to be released from the kite in flight.

Various kite accessory release devices are known in the prior art. Such devices permit the user to release toy objects such as toy bombs and toy parachutes from the kite while it flies aloft.

For example, U.S. Pat. No. 4,183,481 discloses a parachute dropping kite wherein a parachute unit is strapped to the underside of the covering of the kite. This device includes a closure means removably and frictionally associated with the kite. When the kite string is tugged, the closure means is removed permitting the parachute to drop from the kite.

U.S. Pat. No. 5,072,899 discloses a kite accessory release device with a dissolvable member. The release device is tied to the underside of the kite and includes rubber band-biased, cooperating jaws which releasably hold a toy paratrooper. A liquid-filled gelatin capsule serves as a pin to hold the jaws in a closed position. A salt-water solution contained in the capsule gradually dissolves it which causes the jaws to open and the toy paratrooper to be released from the kite.

However, such kite accessory release devices include several component parts and are relatively expensive to manufacture. Thus, the kite accessory release system of the present invention has been developed to provide a simple and inexpensive apparatus to accomplish this function.

2. Description of Related Prior Art

U.S. Pat. No. 4,183,481 to Lloyd C. Elson discloses a parachute dropping kite comprising a parachute unit pocketed or strapped to the underside of the covering of the kite. The strap or pocket is provided with a appropriate means removably and frictionally associated therewith. The device is further provided with a kite string length changing means which is actuated by tugging on the kite string, and located at the position on the kite string where the closure means string is secured to the kite string. When the kite string is tugged, the kite string length changing means is actuated to lengthen the kite string such that the closure means string is lengthened and the closure means is removed permitting the parachute to drop from the strap or pocket.

U.S. Pat. No. 5,072,899 to Steven L. Nickle discloses a kite accessory release device including rubber band-biased cooperating jaws which releasably hold a toy paratrooper while the kite is raised aloft. A liquid filled gelatin capsule serves as a pin to hold the jaws in closed position. A salt-water solution in the capsule dissolves it after a period of time which causes the jaws to open and the toy paratrooper to be released from the kite. Varying the concentration of the saltwater solution controls the amount of time delay before which the capsule dissolves and the toy paratrooper is released.

U.S. Pat. No. 4,799,634 to Nelson K. Beaulieu discloses a hook for releasing a toy parachute from a kite. A hook is fixed to the lower end of the frame of the kite. The hook has an arm curved upwardly toward the top of the kite for supporting an object such as a toy parachute when the kite is in vertical position and for dropping the parachute when the kite has reached a predetermined tilted position.

U.S. Pat. No. 4,123,021 to Claude R. Cruise, Jr. discloses a kite load-releasing messenger for releasing parachutes and other objects from kites including a pendant slider-supported body for engaging a kite string having spring-apart jaws released when a forwardly extending trigger sliding along the kite string strikes a messenger-stop such as a button secured on the line at the kite.

U.S. Pat. No. 4,141,521 to Donald J. Waldvogel discloses a kite parachute toy and releasing device. The parachute toy having a hook and the releasing device having a forward and a rear eyelet for attaching to a kite string. A parachute is attached to the parachute toy and when the hook of the parachute toy is placed over the string of a flying kite, wind will fill the bag of the attached parachute and propel the parachute toy up the string to a releasing device.

U.S. Pat. No. 4,705,239 to Eric A. Baird discloses a toy parachute for attachment to a kite string and for after traveling up the string and contacting stop means then being released from the string for a free flight to the ground. The toy includes a carrier which is slidable up and down the kite string coaxially disposed thereabout. The parachute is releasably coupled to the carrier by a novel split sleeve member having a central aperture into which the upper end of the carrier may be inserted.

U.S. Pat. No. 4,129,274 to Joseph Baker discloses a kite parachute launcher including a wind mill blade disc disposed normal to the kite string and a parachute suspended from a hook having a widely flaring mouth and hooked over the lower end of the kite string to initiate the descent of the parachute, the wind required in flying the kite blowing the hook supported parachute up the kite string, the hook being radially spun from a hooking engagement with the disc launching the parachute into space.

U.S. Pat. No. 2,983,471 to Charles W. Melvin discloses a parachute release device being mounted on the kite string, the wind required in flying the kite blowing the supported parachute up the kite string until it contacts a stop device adjacent the kite whereupon the parachute is mechanically disengaged from the release device and falls to earth.

SUMMARY OF INVENTION

After much study of the prior art, the present invention has been developed to provide a simple, yet effective kite accessory release system which will permit the user to carry a plurality of kite accessory items such as toy bombs and toy parachutes aloft on a kite for subsequent release.

The kite accessory release device of the present system is actuable by tugging on the flexible release device which functions to release the toy accessories for free flight to the ground.

In view of the above, it is an object of the present invention to provide a kite accessory release system which can carry a plurality of kite accessory items such as toy bombs, airplanes, parachutes, and gyrocopters aloft on a kite for subsequent release by the user.

Another object of the present invention is to provide a kite accessory release device which is actuable by tugging on the kite string during flight.

Another object of the present invention is to provide a kite accessory release device which is simple to install, durable for repeated use, and inexpensive to manufacture.

Other objects and advantages of the present invention will become apparent and obvious from a study of the following description and the accompanying drawings which are merely illustrative of such invention.

BRIEF DESCRIPTION OF INVENTION

DETAILED DESCRIPTION OF THE PREFERRED EMBODIMENT

Figure 1:
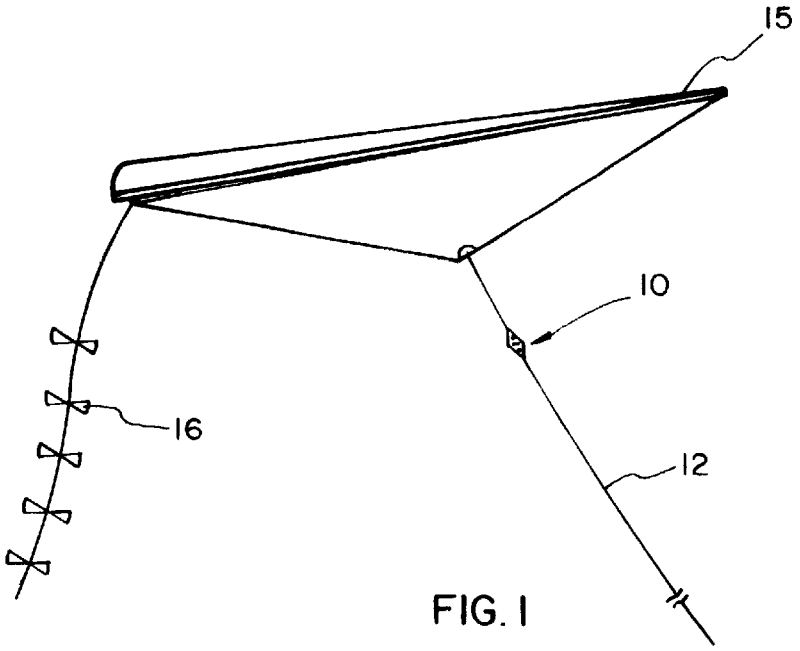
FIG. 1 is a perspective view of the kite accessory release system of the present invention shown attached to a kite.

With further reference to the drawings there is shown therein a kite accessory release device in accordance with the present invention, illustrated generally at 10 and illustrated in FIG. 1. The device 10 is shown installed in its functional position on a kite string 12 attached to a kite 15 having a tail 16.

Since such kites are well known to those skilled in the art, further detailed discussion of the same is not deemed necessary.

Figure 2:
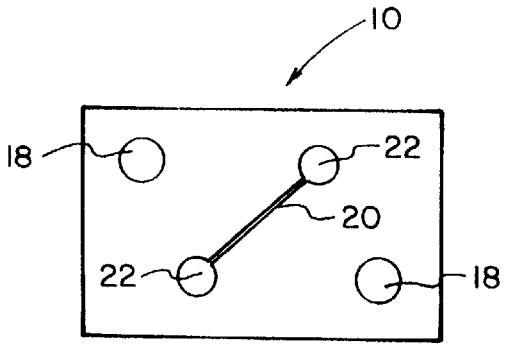
FIG. 2 is an enlarged plan view of the kite accessory release device of the present invention showing the details of the construction thereof.

Referring now to FIG. 2 there is shown therein an enlarged plan view of the device 10. In the preferred embodiment of the present invention, the device 10 is a generally rectangular construction of a durable, elastic material such as neoprene rubber having a durometer value in the range of 30 to 60 or other suitable material.

The device 10 measures approximately 1" wide by 1–½" long by ⅛ thick when fabricated from neoprene rubber as described hereinabove. Of course, various other elastic materials are suitable for this purpose and the embodiment shown is intended to be merely illustrative and not restrictive in any sense.

Figure 3:
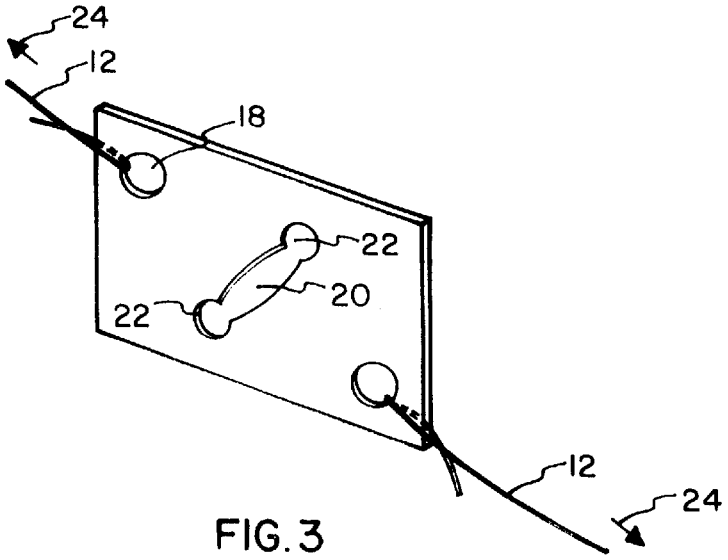
FIG. 3 is a perspective view of the kite accessory release device with linear tension being applied thereto as indicated by directional arrows.

In the preferred embodiment, the device 10 includes at least one pair of kite string holes 18 disposed in opposite corners thereof as shown in FIG. 2 for the attachment of pre-determined lengths of kite string 12 as shown in FIG. 3.

Intermediate the holes 18 an elongated slot 20 is formed so as to lie along a line generally perpendicular to the line defined by the kite string 12. A pair of relief holes 22 are formed at either end of the slot 20 and continuously thereto so as to prevent tearing of the slot 20 beyond its dimensional length when under tension.

Thus, it will be appreciated by those skilled in the art that when linear tension is applied to either section of the kite string 12 as shown by directional arrows 24, the slot 20 is momentarily increased in width as seen in FIG. 3.

Figure 4:
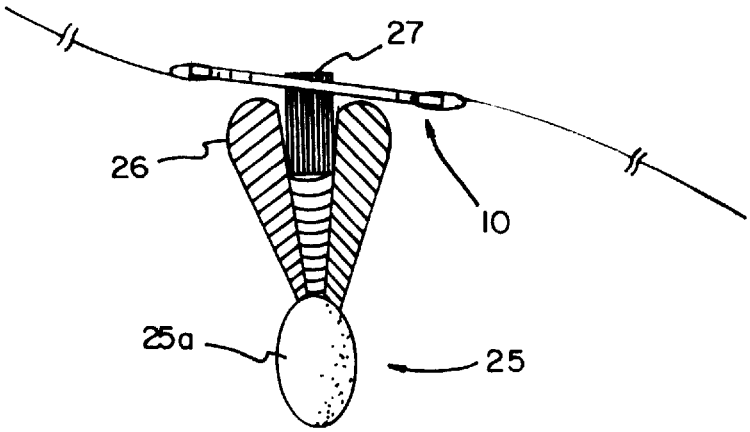
FIG. 4 is a side elevational view of the kite accessory release device shown with a toy bomb inserted therein.

In this manner it will be appreciated to those skilled in the art that a kite accessory item such as a toy bomb 25 having an engagable tab portion 27 of a pre-determined dimension may be temporarily retained in the device 10 by inserting such tab 27 into the slot 20 as shown in FIG. 4.

In the preferred embodiment, the toy bomb 25 is fabricated from a light weight, expanded foam material and may include tail fins 26 formed of molded plastic, expanded foam or rubber to provide stability in flight.

The tab 27 also formed of molded plastic, expanded foam, or rubber extends rearwardly and axially of the body portion 25*a* of the toy bomb 25. The tab 27 is generally rectangular or cylindrical in cross-section and is of a pre-determined dimension to provide an interference fit within the slot 20 so as to be retained therein.

Figure 5:
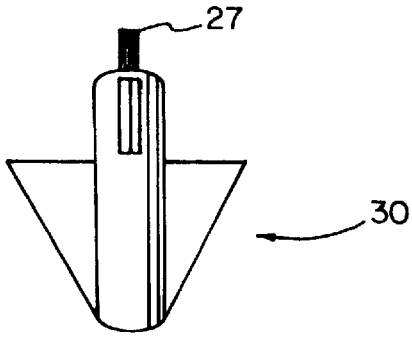
FIG. 5 is a plan view of a toy airplane for use with the device of the present invention.
Figure 6:
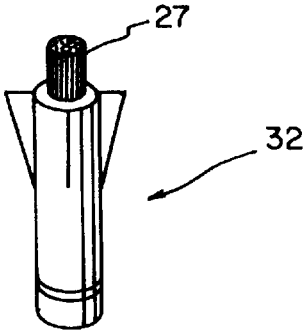
FIG. 6 is a perspective view of a toy missile for use with the device of the present invention.
Figure 7:
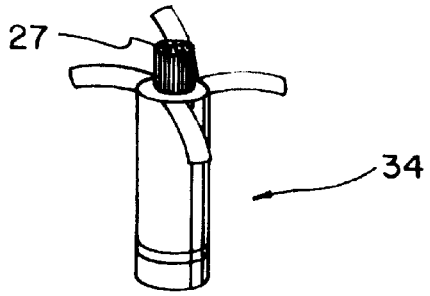
FIG. 7 is a perspective view of a toy gyrocopter for use with the present invention.
Figure 8:
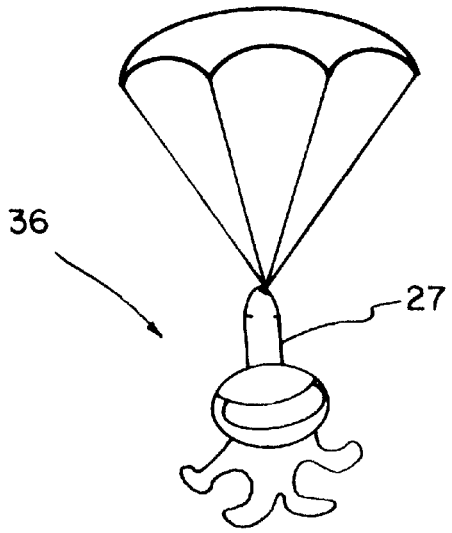
FIG. 8 is a perspective view of a toy paratrooper for use with the present invention.

Various other kite accessory items such as a toy airplane, indicated generally at 30 in FIG. 5; a toy missile, indicated generally at 32 as shown in FIG. 6; a toy gyrocopter, indicated generally at 34 as shown in FIG. 7; and a toy paratrooper with parachute, indicated generally at 36 as shown in FIG. 8 can be used with the devide 10. It will be understood that each of the alternative kite accessory toys described hereinabove include a tab 27 in their construction so as to be compatible with and releasable from the device 10 of the present invention.

Figure 9:
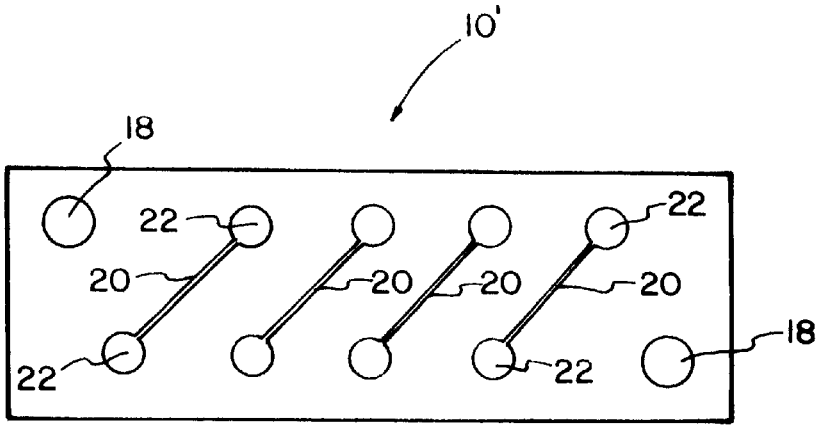
FIG. 9 is a plan view of an alternative embodiment of the kite accessory release device of the present invention.

Referring now to FIG. 9 there is shown therein an alternative embodiment of the kite accessory release device 10" which is constructed so as to be capable of retaining and releasing a plurality of kite accessory items described hereinabove. The alternative embodiment 10' includes a plurality of slots 20 formed in generally parallel relation at regular intervals to accommodate a plurality of toy items for release during flight. In all other respects, the device 10" is similar in overall construction and operation to the device 10 of the preferred embodiment.

In practical use, the kite accessory release device 10 is initially installed on the kite string 12 so as to be positioned in close proximity to the kite 15 as shown in FIG. 1. In a preferred arrangement, the device 10 is attached to a short length of kite string 12 which is secured directly to the kite 15 at one end thereof. The opposite end of the short length of kite string 12 is inserted through a hole 18 and tied thereto using a conventional square knot or other suitable knot. A distal end of the longer portion of the kite string 12 is attached to the hole 18 in the opposite corner of the device 10 and is similiarly secured.

Thereafter, a kite accessory item such as a toy bomb 25 is inserted into a slot 20 such that tab 27 is retained therein in an engaged position.

Next, after the kite 15 has been prepared for flight, the kite 15 is raised aloft by the user 38 in the conventional manner by facing the kite 15 into the wind and gradually releasing a predetermined length of kite string 12 to the position shown in FIG. 1.

Thereafter, the user 38 applies a sudden pull or jerking movement to the kite string 12 which stretches the device 10 as shown in FIG. 3 thereby opening the slot 20 to release the tab 27 causing the toy bomb 25 or other accessory item to fall freely back to the ground for the amusement of the user.

From the above it can be seen that the present invention provides a kite accessory release system which permits the user to release various kite accessory items after the kite has been raised aloft.

The kite accessory release system is adapted for use with a variety of toy items such as toy projectiles, toy airplanes, and toy parachutes.

The kite accessory release device of the present invention is simple and inexpensive to manufacture and is easily installed by a user of ordinary mechanical skills.

The terms "proximal", "distal", "rearward", and so forth have been used herein merely for convenience to describe the present invention and its parts as oriented in the drawings. It is to be understood, however, that these terms are in no way limiting to the invention since such invention may obviously be disposed in different orientations when in use.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. A kite accessory release system for use with a kite, said system comprising:

a generally rectangular kite accessory release device fabricated from a deformable material said device including a plurality of kite string attaching holes formed adjacent opposite corners of said device for attachment of a kite string thereto, said device further including at least one slot formed therein intermediate said holes, said slot being deformable across the width thereof from a closed position to an open position by linear stretching of said device,; and a plurality of interchangeable toy projectiles adapted for retention within said slot in said closed condition and for release from said slot in said open condition such that a user of said kite with said device attached releases said projectiles from said device while flying said kite by application of a jerking movement to said kite string.

2. The kite accessory release system of claim 1 wherein said material is neoprene rubber sheet.

3. The kite accessory release system of claim 2 wherein said neoprene rubber sheet has a durometer reading in the range of 30 to 60.

4. The kite accessory release system of claim 1 wherein said slot includes a pair of holes formed at either end thereof in continuous relation thereto to resist tearing of said device during use.

5. The kite accessory release system of claim 1 wherein said interchangeable toy projectiles include toy bombs, toy missiles, toy airplanes and toy gyrocopters.

6. The kite accessory release system of claim 5 wherein said toy projectiles are fabricated from an expanded foam material.

7. A method of dropping toy projectiles from a kite during flight comprising the steps of:

providing a deformable kite accessory release device having a plurality of expandable slots formed therein for receiving said toy projectiles;

attaching said kite accessory release device within a kite string secured to said kite;

inserting a release tab formed on each said toy projectiles into each of said slots into said device;

flying said kite with said kite accessory release device attached thereto; and applying a jerking movement to said kite string to linearly stretch said release device thereby opening said slots and releasing said toy projectiles.

* * * * *